US012012568B2

(12) United States Patent
Hoevelmann

(10) Patent No.: US 12,012,568 B2
(45) **Date of Patent: *Jun. 18, 2024**

(54) LOW VISCOSITY FUNCTIONAL FLUID COMPOSITION

(71) Applicant: Clariant International Ltd., Muttenz (CH)

(72) Inventor: Felix Hoevelmann, Mühldorf (DE)

(73) Assignee: Clariant International Ltd, Muttenz (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/918,520

(22) PCT Filed: Dec. 2, 2020

(86) PCT No.: PCT/EP2020/084290

§ 371 (c)(1),
(2) Date: Oct. 12, 2022

(87) PCT Pub. No.: WO2021/213693

PCT Pub. Date: Oct. 28, 2021

(65) Prior Publication Data

US 2023/0340359 A1 Oct. 26, 2023

(30) Foreign Application Priority Data

Apr. 23, 2020 (EP) ..... 20171070

(51) Int. Cl.

| | |
|---|---|
| ***C10M 169/04*** | (2006.01) |
| ***C10M 105/18*** | (2006.01) |
| ***C10M 107/34*** | (2006.01) |
| ***C10M 111/04*** | (2006.01) |
| ***C10M 129/08*** | (2006.01) |

(Continued)

(52) U.S. Cl.

CPC ..... *C10M 169/044* (2013.01); *C10M 105/18* (2013.01); *C10M 107/34* (2013.01); *C10M 111/04* (2013.01); *C10M 129/08* (2013.01); *C10M 129/40* (2013.01); *C10M 133/08* (2013.01); *C10M 133/12* (2013.01); *C10M 137/04* (2013.01); *C10M 139/00* (2013.01); *C10M 141/12* (2013.01); *C10M 145/26* (2013.01); *C10M 155/02* (2013.01); *C10M 157/10* (2013.01); *C10M 161/00* (2013.01); *C10M 2207/021* (2013.01); *C10M 2207/046* (2013.01); *C10M 2207/126* (2013.01); *C10M 2209/1075* (2013.01); *C10M 2215/265* (2013.01); *C10M 2223/04* (2013.01); *C10M 2227/061* (2013.01); *C10M 2229/02* (2013.01); *C10N 2030/02* (2013.01);

(Continued)

(58) Field of Classification Search

CPC ..... C10N 2040/08; C10N 2030/12; C10N 2030/40; C10N 2020/015; C10N 2030/02; C10N 2030/08; C10N 2020/02; C10N 2030/18; C10M 157/10; C10M 169/04; C10M 161/00; C10M 137/04; C10M 155/02; C10M 105/18; C10M 129/08; C10M 139/00; C10M 169/044; C10M 107/34; C10M 133/08; C10M 141/12; C10M 145/26; C10M 129/40; C10M 111/04; C10M 133/12; C10M 2209/1075; C10M 2215/265; C10M 2229/047; C10M 2207/026; C10M 2209/1045; C10M 2227/061; C10M 2207/126; C10M 2207/046; C10M 2215/042; C10M 2215/064; C10M 2223/04; C10M 2207/021; C10M 2229/02; C10M 2209/104; C10M 2209/108; C10M 2209/105; C10M 2209/1085

See application file for complete search history.

(56) References Cited

U.S. PATENT DOCUMENTS

| | | | | |
|---|---|---|---|---|
| 4,371,448 | A | 2/1983 | Knoblauch | |
| 2006/0026433 | A1 | 2/2006 | Montenegro | |
| 2011/0207636 | A1* | 8/2011 | Zhao | C23F 11/10 508/304 |
| 2016/0237366 | A1 | 8/2016 | Dietl | |

FOREIGN PATENT DOCUMENTS

| | | |
|---|---|---|
| CN | 86101976 | 8/1986 |
| CN | 104302747 | 1/2015 |
| DE | 2253888 | 5/1973 |
| DE | 3627432 A1 | 2/1988 |
| EP | 0617116 | 9/1994 |
| EP | 0750033 | 12/1996 |

(Continued)

OTHER PUBLICATIONS

Chinese Search Report issued in App. No. CN202080005951.1, 2 pages, 2020.
Federal Motor Vehicle Safety Standards (FMVSS) No. 116. 2006.
ISO 4925. 2005.
SAE International J 1703. 2019.

*Primary Examiner* — Vishal V Vasisth

(57) ABSTRACT

This invention relates to a functional fluid, comprising: (A) from 50 to 85 wt.-% of alkoxy glycol according to formula (I): $CH_3$—O—($CH_2$—$CH_2$—O)$_n$—H, wherein n is a number from 2 to 5, with the proviso that in at least 30 wt.-% of all compounds according to formula (I), n is 3, and (B) from 1 to 20 wt.-% of alkoxy glycol according to formula (II): $R_1$—O—($CH_2$—$CH_2$—O)$_m$—H, wherein $R_1$ is a C2 to C8 alkyl residue, m is a number from 2 to 6, with the proviso that in at least 65 wt.-% of all compounds according to formula (II), m is 3, and (C) from 6 to 35 wt.-% of at least one compound according to formula (III): H—O—($CH_2$—$CH_2$—O)$_k$—H, wherein k is a number of 2 or higher, with the proviso that in at least 80 wt.-% of all compounds according to formula (III), k is 2 or 3, (D) at least one additive.

26 Claims, No Drawings

(51) Int. Cl.

| | |
|---|---|
| ***C10M 129/40*** | (2006.01) |
| ***C10M 133/08*** | (2006.01) |
| ***C10M 133/12*** | (2006.01) |
| ***C10M 137/04*** | (2006.01) |
| ***C10M 139/00*** | (2006.01) |
| ***C10M 141/12*** | (2006.01) |
| ***C10M 145/26*** | (2006.01) |
| ***C10M 155/02*** | (2006.01) |
| ***C10M 157/10*** | (2006.01) |
| ***C10M 161/00*** | (2006.01) |
| *C10N 30/02* | (2006.01) |
| *C10N 30/12* | (2006.01) |
| *C10N 30/18* | (2006.01) |
| *C10N 40/08* | (2006.01) |

(52) U.S. Cl.
CPC ..... *C10N 2030/12* (2013.01); *C10N 2030/18* (2013.01); *C10N 2040/08* (2013.01)

(56) References Cited

FOREIGN PATENT DOCUMENTS

| | | |
|---|---|---|
| JP | S4855185 | 8/1973 |
| JP | S59204694 | 11/1984 |
| WO | 0065001 | 11/2000 |
| WO | 0238711 | 5/2002 |
| WO | 2007005593 | 1/2007 |
| WO | 2012003117 | 1/2012 |
| WO | 2021213693 | 10/2021 |

* cited by examiner

LOW VISCOSITY FUNCTIONAL FLUID COMPOSITION

The present invention relates to a low viscosity functional fluid composition comprising a mixture of alkyl polyglycols, polyglycols and additives, the fluid having a low content in boric acid esters of glycols or alkyl polyglycols. The fluid exhibits a low temperature kinematic viscosity of less than 800 centistokes, determined at −40° C., exhibits an equilibrium reflux boiling point (ERBP) of at least 250° C. and a wet equilibrium reflux boiling point (WERBP) of at least 160° C., according to the methods described in the Federal Motor Vehicle Safety Standards (FMVSS) No 116.

The low viscosity functional fluid composition according to the present invention is useful in a variety of applications and in particular as brake fluid, especially for new electronic or automated anti-lock brake systems which require lower viscosity fluids for satisfactory operation at low temperatures.

Functional fluid compositions based on borate esters are well known in the art. To be useful for example as DOT 4 or DOT 5.1 brake fluids, these borate ester based compositions must meet stringent physical properties and performance requirements particularly with respect to minimum dry equilibrium reflux boiling point ("ERBP"), minimum wet equilibrium reflux boiling point ("WERBP") and maximum low temperature kinematic viscosity (e.g. determined at −40° C.) while maintaining adequate resistance to temperature, stability and meeting other physical property requirements such as pH, reserve alkalinity, corrosion protection and rubber swelling.

While borate esters are advantageous to meet the DOT 4 and DOT 5.1 criteria according to Federal Motor Vehicle Safety Standards (FMVSS) No 116, especially a very high wet boiling point (WERBP), borate containing brake fluids are associated with two problems. Federal Motor Vehicle Safety Standards (FMVSS) No 116 refers to 49 CFR § 571.116 in the Oct. 1, 2016 edition and will be referred to as FMVSS in this specification.

1.) Boric acid is known to be a CMR-compound (repro tox category 1). Therefore, also its esters are suspect to similar health threat (currently classified as repro tox category 2) and, therefore of potential danger during storage, handling and filling of the brake fluid.

2.) The content of boron in the brake fluids is associated with a certain risk of gel formation or precipitation due to salt formation of the inorganic character of boron salts, especially upon ageing of the brake fluids As a result, particles may occur in the brake fluid and limit its performance in critical situations.

WO-00/65001 describes hydraulic fluids comprising alkoxy glycol borate esters, alkoxy glycols and corrosion inhibitors, additionally containing cyclic carboxylic acid derivatives.

WO-02/38711 describes low viscosity functional fluid compositions comprising alkoxy glycol borate esters, alkoxy glycol components and additives such as corrosion inhibitors, wherein the alkoxylation degrees of the alkoxy glycol borate esters and the alkoxy glycols are restricted to a certain narrow pattern.

U.S. Pat. No. 4,371,448A teaches a hydraulic fluid which formally fulfils the specification DOT 5. This hydraulic fluid essentially consists of (A) about 20 to 40% by weight of at least one boric acid ester obtained from orthoboric acid, diethylene glycol and an ethylene glycol mono alkyl ether; (B) 30 to 60% by weight of at least one ethylene glycol monoalkyl ether; (C) 10 to 40% by weight of at least one bis-(ethylene glycol monoalkyl ether)-formal; (D) 0.1 to 5% by weight of at least one alkylamine; and (E) 0.05 to 5% by weight of at least one stabilizer and/or inhibitor; the percentages by weight in each case being relative to the total weight of the fluid.

EP-0750033A1 teaches a hydraulic fluid composition, especially a brake fluid composition, based on a boric ester of a glycol ether and comprising a corrosion-inhibiting system which includes: (1) at least one constituent (A) chosen from fatty amines or the salts of one or more carboxylic acids with the said amines, and (2) at least one constituent (B) chosen from the products resulting from the reaction of one or more carboxylic fatty acids with a polyoxyalkylene glycol, or from the transesterification reaction of one or more esters of carboxylic fatty acids with a polyoxyalkylene glycol.

EP-0617116A1 teaches a hydraulic fluid composition having a high boiling point, in particular a high equilibrium reflux boiling point and a low viscosity. The composition contains, as additive, at least one ether amine having a molecular weight between 120 and 300 and having the formula

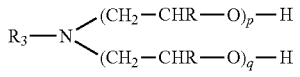

in which $R_3$ is linear or branched radical having at least one ether functional group and no alcohol functional group, R is a methyl radical or a hydrogen atom, p is an integer from 1 to 3 and q is an integer from 0 to 2.

WO-2012/003117A1 discloses a functional fluid composition comprising (i) an alkoxy glycol mixture in an amount of about 38% to 47% by weight of the functional fluid composition, where the alkoxy glycol mixture is comprised alkoxy glycols having the formula

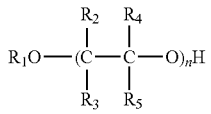

with repeat unit:

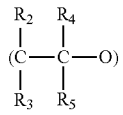

wherein each of $R_1$, $R_2$, $R_3$, $R_4$, $R_5$ is either hydrogen (H) or an alkyl group containing 1 to 8 or more carbon atoms or mixtures thereof, wherein said mixture has a first alkoxy glycol component in an amount of about 36% to about 73% by weight of said mixture where n=3, a second alkoxy glycol component from 17% to about 43% by weight of said mixture where n=4, and a third alkoxy glycol component in an amount from about 2% to about 10% by weight of said mixture where n is greater than or equal to 5 and (ii) a glycol borate ester in an amount of about 53% to 62% by weight of the functional fluid composition.

DE-2253888 teaches hydraulic fluids comprising (a) 45-60 parts of tetraethylene glycol or 40-60 parts of a mixt. of tetraethylene glycol and at least one glycol of formula (I) H—$(OCH2CHX)_y$—OH, where X is H or Me; y>=2, provided that when X=Me, (I) is present in an amt. of 0.5-5.0 wt.%; and (b) 60-20 wt. parts of a diluent selected from (i) at least one compound of formula (II): H—$(OCH2CHX)_3$—OR (where R is lower alkyl), (ii) a mixt. of at least one cpd. (II) and at least one cpd. of formula (III): H—$(OCH2CH2)_2$—OR1 (where R1 is lower alkyl), and (iii) compound (III) where R1=Bu, as hydraulic brake fluids, automatic transmission fluids and hydraulic fluids for various other uses. The fluids have reduced sensitivity to moisture, their minimum boiling point in the moist state being 155 degrees C.

DE3627432 teaches a brake fluid based on glycols and glycol ethers, consisting essentially of A) 30 to 80% by weight, based on the total weight of the brake fluid, of a glycol component, consisting of a) 0 to 80% by weight diethylene glycol and/or dipropylene glycol and b) 20 to 100% by weight of triethylene glycol, tripropylene glycol, tetraethylene glycol and/or tetrapropylene glycol, percent by weight based on the mixture of these glycols, B) 20 to 70% by weight, based on the total weight of the brake fluid, of a glycol ether component, consisting of a) 10 to 100% by weight. -% of at least one glycol dialkyl ether of the following formula R—$(OAlk1)_x$—OR1, in which R and R1 are an alkyl group with 1 to 4C atoms, Alk1 is the ethylene or a propylene group and x is an integer from 3 to 6, and b) 0 to 90 wt. -% of at least one glycol monoalkyl ether of the following formula R2-$(OAlk2)_y$—OH, in which R2 is an alkyl group with 1 to 4 carbon atoms, Alk2 is the ethylene or a propylene group and y is an integer from 2 to 4, percent by weight based on the mixture of these glycol ethers, and C) 0 to 5% by weight, based on the total weight of the brake fluid, of at least one inhibitor for fluids based on glycol and glycol ethers, with the proviso that at least 14% by weight in the brake fluid of the glycol component b) are contained, weight percent based on the total weight of the brake fluid.

There is a strong demand for improved high-performance hydraulic fluid compositions and brake fluids having low temperature viscosity while meeting or exceeding at the same time the minimum ERBP and especially the WERBP temperature requirements, as fulfilled by the hydraulic fluid compositions and brake fluids commonly used.

Examples of borate-free brake fluids are described in the literature

1.) DOT3/class 3 fluids, which are in general of a lower ERBP, lower WERBP and higher viscosity at −40° C.), according to FMVSS.

2.) DE-3627432C2 (Hoechst) and US2006/0264337 (BASF) disclose diethylene/triethylene glycol and dipropylene glycol based brake fluids, fulfilling just the minimum requirement of DOT 4 and ISO 4925 class 4 norm.

3.) WO-2007/005593A2 (DOW) describes compositions of brake fluids containing 0-10 wt.-% of borate ester and the use of larger quantities of butoxy-glycols, mainly butoxy-triglycol.

These developments allow for high ERBP but suffer from a still too high viscosity at −40° C. and from a low WERBP. The problem to be solved by the instant invention is to provide a hydraulic fluid having the properties mentioned below and being essentially or entirely borate free.

| | WO-2007/005593A2 (DOW) | US-2006/0264337 (BASF) "BF1" | DE-3627432 (Examples) | Target of the present invention |
|---|---|---|---|---|
| ERBP | 270° C. | 251 | 237-277 | min. 250° C. |
| WERBP | 145° C. | 159° C. | 144-158 | min. 160° C. |
| Viscosity at −40° C. | 859 cSt | 1393 $mm^2/s$ | 1000-1450 $mm^2/s$ | max. 750 $mm^2/s$ |

Yet, a borate-free composition, fulfilling these criteria is not known.

According to the present invention, a functional fluid composition has been found which exhibits superior values of ERBP and of WERBP and for low temperature kinematic viscosity, while maintaining excellent resistance to corrosion, high stability and meeting other physical property requirements such as pH, reserve alkalinity and rubber swell. Especially very high WERBP values are achieved.

In a first aspect, this invention relates to a functional fluid, comprising (A) from 50 to 85, preferably 60-82 wt.-% of alkoxy glycol according to formula (I)

$$CH_3—O—(CH_2—CH_2—O)_n—H \quad (I)$$

wherein n is a number from 2 to 5, with the proviso that in at least 30 wt.-% of all compounds according to formula (I) n is 3, and (B) from 1 to 15, preferably 1.5 to 10 wt.-% of alkoxy glycol according to formula (II)

$$R_1—O—(CH_2—CH_2—O)_m—H \quad (II)$$

wherein $R_1$ is a $C_2$ to $C_8$ alkyl residue, m is a number from 2 to 6, with the proviso that in at least 65 wt.-% of all compounds according to formula (II) m is 3, and (C) from 6 to 35, preferably 10-25 wt.-% of at least one compound according to formula (III)

$$H—O—(CH_2—CH_2—O)_k—H \quad (III)$$

wherein k is a number of 2 or higher, with the proviso that in at least 80 wt.-% of all compounds according to formula (III) k is 2 or 3, (D) at least one additive, selected from the group consisting of corrosion inhibitor, amines, stabilizers, defoamers and lubricants, the fluid comprising at most 3 wt.-% of an ester between boric acid and a glycol or polyglycol compound.

In a second aspect, this invention provides the use of the functional fluid of the first aspect as a brake fluid for vehicular brakes.

In a third aspect, this invention provides for a method of operating a vehicular brake that transmits braking force through a hydraulic system, the method comprising filling the hydraulic system with a functional fluid according to the first aspect.

The functional fluid may be referred to as "fluid" in the following.

Component (A) of the functional fluid according to this invention is a methyl-terminated polyglycol according to formula (I). Suitable compounds according to formula (I) comprise 2, 3, 4 or 5 ethoxy units. Compounds with a higher number of ethoxy units than 5, i.e. 6 ethoxy units or more, may be present but should be restricted to a content of 3 wt.-% at most, relative to the total weight of all compounds according to formula (I).

The total amount of all compounds according to formula (I) in the fluid is from 50 to 85 wt.-%, relative to the weight of the fluid, preferably 60-82 wt.-%, more preferably 65-81 wt.-%, for example preferably 68-80 wt.-%. The relative amount of any formula (I) component with n=2 preferably is not more than 2.5 wt.-%. The relative amount of any formula (I) component with n=3 is at least 30 wt.-%, preferably 50 to 90 wt.-%. The relative amount of any formula (I) component with n=4 and 5 is preferably 10-50 wt.-%, more preferably 13-49 wt.-%. All such relative amounts are relative to the total amount of formula (I) compounds, such total amount being 100 wt.-%. In component (A), species with n=1 are preferably not present in quantities higher than 1 wt.-%. In component (A), species with n=6 or higher are preferably not present in quantities higher than 3 wt.-%.

Increasing the amount of formula (I) components with n=4 or higher may rise the viscosity of the fluid.

Component (B) of the functional fluid composition, according to formula (II), comprises species of ethoxylation degrees of from m=2 to m=6, preferably of from m=2 to m=4. Component (B) may be a single species or a mixture of different species with regards to the ethoxylation degree and/or to radical $R_1$. Radical $R_1$ is preferably a $C_2$- to $C_4$-alkyl radical. $R_1$ more preferably may be ethyl, n-propyl, isopropyl, n-butyl, isobutyl, sec-butyl, tert-butyl. Ethyl, and especially butyl is most preferred.

Examples of useful alkoxy glycols for component (B) of the present invention include ethyldiglycol, ethyltriglycol, ethyltetraglycol, ethylpentaglycol, ethylhexaglycol, n-propyldiglycol, n-propyltriglycol, n-propyltetraglycol, n-propylpentaglycol, n-propylhexaglycol, n-butyldiglycol, n-butyltriglycol, n-butyltetraglycol, n-butylpentaglycol, n-butylhexaglycol and mixtures thereof. For the avoidance of doubt, "glycol" always means "ethylene glycol". Preferred are butyltriglycol and butyltetraglycol.

The component (B) preferably comprises a mixture of alkoxy glycols of general formula (II) comprising solely or predominantly species with m=3. Predominantly means that at least 65% by weight, more preferably at least 75% by weight, of component (B) comprises species with m=3. Species with m=4 are preferably present in an amount of 10 wt.-% or more. In any case, alkoxy glycol species with m=2 and/or m=5 and/or m=6 may be present in minor amounts. Species with m=2 are preferably present in an amount not exceeding 3 wt.-%. Species with m=5, 6 or higher are preferably present in an amount of less than 5 wt.-% in total. Weight percentages of species of component (B) are given in wt.-% with the total amount of component (B) being 100 wt.-%. The total amount of all compounds according to formula (II) in the fluid is from 1 to 15, preferably 1.5 to 10 wt.-%.

Component (C) is a polyethylene glycol according to formula (III). In formula (III), k is a number of 2, or higher. It is preferred, that k is a number from 2-4. More preferably, k is 2 or 3.

It is required that in at least 80 wt.-% of all compounds according to formula (III) k is 2 or 3, the wt.-% being relative to the total weight of all compounds according to formula (III). This means that compounds according to formula (III) wherein k is 2 or 3 make up 4.8 to 28 wt.-%, preferably 8 to 20 wt.-% of the fluid, the total fluid weight being 100 wt.-%.

In one preferred embodiment, component (C) is a mixture of compounds according to formula (III) wherein k is 2 or 3.

The total amount of component (C) in the fluid is from 6 to 35 wt.-%, preferably 10-25 wt.-%, more preferably 16 to 23 wt.-% of the weight of the fluid, i.e. the total weight of the fluid being 100 wt.-%.

In one preferred embodiment, the amount of species of formula (III) wherein k=2 is 6-12 wt.-%. In one other preferred embodiment, the amount of species of formula (III) wherein k=3 is 5-15 wt.-%. In one other preferred embodiment, the total amount of species according to formula (III) wherein k is 4 or higher than 4 is at most 8 wt.-%, more preferably at most 5 wt.-%. Said weight percentages provided for species according to formula (III) are provided as weight percentages of the fluid, i.e. the total weight of the fluid is 100 wt.-%. They are not provided as weight percentages of the total weight of component (C).

Component (D) is an additive that is required to impart particular properties to the functional fluid for performing on specifications to be fulfilled for brake fluids according to the current norms and standards FMVSS, SAE J 1703 and ISO 4925. The preferred total amount of all components (D) in the fluid is from 0.4 to 6 wt.-%, more preferably from 0.5 to 5.5 wt.-%.

Component (D) comprises one or more additives selected from the group consisting of corrosion inhibitors, amines as reserve alkalinity agents, stabilizing antioxidants, defoamers, lubricants and dyes.

Component (D) may comprise an amine. Amines are preferably alkyl or cycloalkyl amines, alkanol amines, alkyl amine ethoxylates and their mixtures. Preferred cycloalkyl groups have 5 to 12 carbon atoms. Preferred alkyl amines are mono- and di-($C_4$- to $C_{20}$-alkyl)amines. Examples of suitable alkyl or cycloalkyl amines are n-butylamine, n-hexylamine, n-octylamine, 2-ethylhexylamine, isononylamine, n-decylamine, n-dodecylamine, oleylamine, d-n-propylamine, di-isopropylamine, di-n-butylamine, tri-n-butylamine, di-n-amylamine, cyclohexylamine, and salts of such amines. Examples of suitable alkanolamines are mono-, di- and trimethanolamine, mono-, di- and triethanolamine, mono-, di- and tri-n-propanolamine and mono-, di- and tri-isopropanolamine. Examples of suitable alkyl amine ethoxylates are such linear or branched alkylamine ethoxylates carrying 1.5 to 5 EO moieties and an alkyl chain having 8 to 18 carbon atoms. Preferred alkanol amines have one, two or three hydroxyaliphatic groups bonded to the amine nitrogen atom, the hydroxyaliphatic groups having from 2 to 6 carbon atoms. Particularly preferred are monoethanolamine, diethanolamine, triethanolamine and di-isopropanolamine.

Component (D) of the present functional fluid composition may comprise, besides the Amine, at least one additive with corrosion inhibition action, although the alkylamine ethoxylates exhibit corrosion inhibition properties themselves. Suitable customary additives with corrosion inhibition properties include fatty acids such as lauric, palmitic, stearic or oleic acid; esters of phosphorus or phosphoric acid with aliphatic alcohols or aliphatic alcohol ethoxylates; phosphites such as ethyl phosphate, dimethyl phosphate, isopropyl phosphate, n-butyl phosphate, triphenyl phosphite and diisopropyl phosphite; heterocyclic nitrogen containing organic compounds such as benzotriazole, tolyltriazole, 1,2, 4-triazole, benzoimidazole, purine, adenine and derivatives of such heterocyclic organic compounds. Of course, mixtures of the above additives with corrosion inhibition action can be used.

Defoamers may be selected from the groups of oil based defoamers, such as natural oils, glycerides or waxes, fine powdered silica, alkoxylates such es EO/PO block copolymers, silicone based defoamers, preferably polyether modified or silicone derivatives and mixtures thereof.

The fluid may include from 0 to 5% by weight, based on the total weight of the composition, of a lubricant. Suitable lubricants are for example, polypropylene oxides, random poly ($C_2$- to $C_4$-alkylene) oxides, random mono $C_1$ to $C_4$ substituted poly ($C_2$- to $C_4$-alkylene) oxides, castor oil, ricinoleic acid, and ethoxylates of castor oil or ricinoleic acid and mixtures thereof.

Suitable stabilizers, which also may be referred to as antioxidants or aging protection agents, are substituted phenols, like Bisphenols (e.g. Bisphenol A or Bisphenol M), butyl hydroxytoluene, methoxy phenols, butylated hydroxy anisole, hydroquinone derivatives; sterically hindered amines such as benzylated, alkylated or styrenated diphenylamine, styrenated phenylamine, substituted piperidine derivatives, phenothiazine derivatives or quinoline derivatives and mixtures thereof. In general, any literature known glycol stabilizing agents could be used herein.

In one preferred embodiment, the % values (A)-(D) add up to 100% by weight.

The total content of the fluid in boric acid esters is at most 3 wt.-%, preferably less than 0.3 wt.-%.

In one preferred embodiment, the weight ratio between component (A) and component (B) is (A):(B)=82:1 to 6:1.

In one preferred embodiment, the weight ratio between compounds according formula (I) with n=3 and n=4 or higher is (n=3):(n=4, or higher)=1:1 to 6:1.

In one preferred embodiment, the weight ratio between component (A) and component (C) is (A):(C)=2.0:1 to 8.2:1.

In one embodiment, the subject matter of this invention corresponds to a functional fluid, comprising (A) from 50 to 85, preferably 60-82 wt.-% of alkoxy glycol according to formula (I)

$$CH_3—O—(CH_2—CH_2—O)_n—H \quad (I)$$

wherein n is a number from 2 to 5, with the proviso that in at least 30 wt.-% of all compounds according to formula (I) n is 3, and (B) from 1 to 15, preferably 1.5 to 10 wt.-% of alkoxy glycol according to formula (II)

$$R_1—O—(CH_2—CH_2—O)_m—H \quad (II)$$

wherein $R_1$ is a $C_2$ to $C_8$ alkyl residue, m is a number from 2 to 6, with the proviso that in at least 65 wt.-% of all compounds according to formula (II) m is 3, and (C) from 6 to 35, preferably 10-25 wt.-% of at least one compound according to formula (III)

$$H—O—(CH_2—CH_2—O)_k—H \quad (III)$$

wherein k is a number of 2 or higher, with the proviso that in at least 80 wt.-% of all compounds according to formula (III) k is 2 or 3, (D) at least one additive, selected from the group consisting of corrosion inhibitor, amines, stabilizers, defoamers and lubricants, the fluid comprising at most 3 wt.-% of an ester between boric acid and a glycol or alkyl polyglycol compound, wherein component (D) is present in an amount of 0.4 to 6 wt.-%, preferably 0.5 to 5.5 wt.-%, and wherein the corrosion inhibitor is selected from the group consisting of $C_8$ to $C_{22}$ fatty acids, esters of phosphorus or phosphoric acid with $C_1$ to $C_{18}$ aliphatic alcohols, phosphites having at least one $C_1$ to $C_{12}$ hydrocarbon residue; heterocyclic organic compounds having at least one nitrogen atom as heteroatom, and mixtures thereof; and wherein the amine is selected from the group consisting of alkyl or cycloalkyl amines, alkanol amines, alkyl amine ethoxylates and their mixtures; and wherein the stabilizer is selected from the group consisting of substituted phenols, sterically hindered amines and mixtures thereof; and wherein the defoamer is selected from the group consisting of natural oils, glycerides, waxes, fine powdered silica, ethylene oxide/propylene oxide block copolymers, silicone based defoam and mixtures thereof; and wherein the lubricant is selected from the group consisting of polypropylene oxides, random poly ($C_2$- to $C_4$-alkylene) oxides, random mono $C_1$ to $C_4$ substituted poly ($C_2$- to $C_4$-alkylene) oxides, castor oil, ricinoleic acid, ethoxylates of castor oil or ricinoleic acid, and mixtures thereof.

The functional fluid composition of the present invention exhibits superior behavior in ERBP and WERBP temperature and simultaneously in low temperature viscosity performance. It exhibits an ERBP of at least 250° C., more preferably of at least 260° C. and a WERBP of at least 160° C., more preferably at least 165° C. The functional fluid composition of the present invention exhibits a low temperature kinematic viscosity of less than 800 centistokes ("cSt") (=$mm^2/s$), more preferably of less than 750 cSt, each determined at a temperature of −40° C. Selected examples of the functional fluid composition of the present invention may meet the requirements of ISO 4925 class 6 brake fluids of ERBP min 250° C., WERBP of min 165° C. and a maximum viscosity at −40° C. of 750 cSt. Analytical methods are described in FMVSS to which reference is made. In general, the viscosity of the fluid is dependent on the viscosity of its components. If a fluid according to this invention does not exhibit a kinematic viscosity of less than 800 centistokes, replacement of parts of components (B) and (C) by component (A) wherein n is 3 or less will decrease the kinematic viscosity. Care needs to be taken that the ERBP and the WERBP remain at above 250° C. and 160° C., respectively upon such replacement. It is necessary to choose a suitable component (A) for the replacement, and to adjust the ratio between (B) and (C) in a way to keep ERBP and WERBP within the desired range.

The low viscosity functional fluid composition of the present invention is especially useful as a brake fluid, for example for vehicles such as passenger cars and trucks, especially for new electronic or automated anti-lock brake systems which require lower viscosity fluids for satisfactory operation at low temperatures.

Besides its superior behavior in ERBP and WERBP temperature and its low temperature viscosity performance, the functional fluid composition of the present invention exhibits a good corrosion protection, a good water compatibility, a mild pH value, a good stability with regard to low and high temperatures, a good oxidation stability, a good chemical stability, a good behavior towards rubber and elastomers. a good lubrication performance and good foaming behavior.

EXAMPLES

Table 1 shows functional fluid compositions and their performance. Numbers are provided in wt.-%, unless noted otherwise.

TABLE 1

| | Example 1 (◆) | | Example 2 (◆) | | Example 3 (◆) | | Example 4 (◆) | |
|---|---|---|---|---|---|---|---|---|
| Component A | 71.598 | | 70.238 | | 72.813 | | 74.15 | |
| n = 2 | | | | | | 0 | | 0.5 |
| n = 3 | | 51.698 | | 50.238 | | 37.813 | | 63.65 |
| 4 and 5 (>60% n = 4) | | 19.9 | | 20 | | 35 | | 10 |
| Component B ($R_1$ = n-butyl) | 9 | | 9 | | 9.9 | | 2 | |
| m = 3 | | 7.2 | | 7.2 | | 7.92 | | 1.6 |
| m = 4 and higher (>80% m = 4) | | 1.8 | | 1.8 | | 1.98 | | 0.4 |
| Component C | 18 | | 16.5 | | 16 | | 23 | |
| k = 2 (DEG) | | 9.5 | | 8 | | 8.5 | | 9.5 |
| k = 3 (TEG) | | 8.5 | | 8.5 | | 7.5 | | 10 |
| k = 4 and higher | | | | | | | | 3.5 |
| Component D | 1.4015 | | 4.2615 | | 1.2865 | | 0.8513 | |
| Lubricant | | | | | | | | |
| ethylene/propylene oxide random copolymer mono butyl ether | | | | 3 | | | | |
| Castor Oil ethoxylate (50 wt-% EO) | | | | | | 0.1 | | |
| Amine | | | | | | | | |
| Diisopropanol amine | | 1.04 | | | | 0.935 | | 0.5 |
| Octylamine + 2EO | | | | 1 | | | | |
| Rest | | | | | | | | |
| Defoamer (polyether modified siloxane) | | 0.001 | | 0.001 | | 0.001 | | 0.001 |
| BHT | | | | | | 0.2 | | 0.2 |
| styrenated diphenylamine | | 0.2 | | 0.2 | | | | |
| Oleic acid | | 0.1 | | | | | | 0.1 |
| Phosphoric acid ester | | 0.06 | | 0.06 | | 0.05 | | 0.05 |
| dye stuff | | 0.0005 | | 0.0005 | | 0.0005 | | 0.0003 |
| Total | 100.000 | | 100.000 | | 100.000 | | 100.00 | |
| WERBP [° C.] | 166 (◆) | | 161 (◆) | | 162 (◆) | | 165 (◆) | |
| ERBP [° C.] | 258 (◆) | | 261 (◆) | | 263 (◆) | | 264 (◆) | |
| viscosity (−40° C.) [$mm^2/s$] | 701 (◆) | | 709 (◆) | | 742 (◆) | | 733 (◆) | |
| Component ratios | | | | | | | | |
| Component A:B | 7.96 | | 7.8 | | 7.35 | | 37.08 | |
| Component A n = 3/n = 4 or higher | 2.60 | | 2.51 | | 1.08 | | 6.37 | |
| Component A:C | 3.98 | | 4.26 | | 4.55 | | 3.22 | |

| | Comparative example 1 (■) | | Comparative example 2 (■) | | Comparative example 3 (■) | |
|---|---|---|---|---|---|---|
| Component A | 64.788 | | 60.938 | | 65.6385 | |
| N = 2 | | | | | | |
| n = 3 | | 9 (■) | | 25.15 | | 45.6385 |
| 4 and 5 (>60% n = 4) | | 55.788 | | 35.788 | | 20 |
| Component B ($R_1$ = n-butyl) | 19.15 | | 20 (■) | | 9 | |
| m = 3 | | 15.32 | | 16 | | 7.2 |
| m = 4 and higher (>80% m = 4) | | 3.83 | | 4 | | 1.8 |
| Component C | 15 | | 18 | | 16.5 | |
| k = 2 (DEG) | | 8 | | 9.5 | | 8 |
| k = 3 (TEG) | | 7 | | 8.5 | | 4 |
| k = 4 and higher | | | | | | 4.5 (■) |
| Component D | 1.0615 | | 1.0615 | | 8.8615 | |
| Lubricant | | | | | | |
| ethylene/propylene oxide random copolymer mono butyl ether | | | | | | 8 |
| Castor Oil ethoxylate (50 wt-% EO) | | | | | | |
| Amine | | | | | | |
| Diisopropanol amine | | 0.5 | | 0.5 | | 0.5 |
| Octylamine + 2EO | | | | | | |
| Rest | | | | | | |
| Defoamer (polyether modified siloxane) | | 0.001 | | 0.001 | | 0.001 |
| BHT | | 0.2 | | 0.2 | | |
| styrenated diphenylamine | | 0.2 | | 0.2 | | 0.2 |
| Oleic acid | | 0.1 | | 0.1 | | 0.1 |
| Phosphoric acid ester | | 0.06 | | 0.06 | | 0.06 |
| dye stuff | | 0.0005 | | 0.0005 | | 0.0005 |
| Total | 100.000 | | 100.000 | | 100.000 | |
| WERBP [° C.] | 158 (■) | | 157 (■) | | 159 (■) | |
| ERBP [° C.] | 274 (◆) | | 267 (◆) | | 262 (◆) | |
| viscosity (−40° C.) [$mm^2/s$] | 920 (■) | | 803 (■) | | 968 (■) | |

TABLE 1-continued

| Component ratios | | | |
|---|---|---|---|
| Component A:B | 3.38 | 3.05 | 7.29 |
| Component A n = 3/n = 4 or higher | 0.16 | 0.70 | 2.28 |
| Component A:C | 4.32 | 3.39 | 3.98 |

(♦) = according to the present invention, or according to the required specification
(■) = not according to the invention, or not according to the required specification

The invention claimed is:

1. A functional fluid, comprising (A) from 50 to 85 wt.-% of alkoxy glycol according to formula (I)

$$CH_3—O—(CH_2—CH_2—O)_n—H \quad (I)$$

wherein n is a number from 2 to 5, with the proviso that in at least 30 wt.-% of all compounds according to formula (I), n is 3;

(B) from 1 to 15 wt.-% of alkoxy glycol according to formula (II)

$$R_1—O—(CH_2—CH_2—O)_m—H \quad (II)$$

wherein $R_1$ is a $C_2$ to $C_8$ alkyl residue, m is a number from 2 to 6, with the proviso that in at least 65 wt.-% of all compounds according to formula (II), m is 3;

(C) from 6 to 35 wt.-% of at least one compound according to formula (III)

$$H—O—(CH_2—CH_2—O)_k—H \quad (III)$$

wherein k is a number of 2 or higher, with the proviso that in at least 80 wt.-% of all compounds according to formula (III), k is 2 or 3; and (D) at least one additive, selected from the group consisting of corrosion inhibitor, amines, stabilizers, defoamers and lubricants, wherein the fluid comprises at most 3 wt.-% of an ester of boric acid and a glycol or alkyl polyglycol compound.

2. The functional fluid according to claim 1, wherein the components (A) to (D) add up to 100 wt.-%.

3. The functional fluid according to claim 1, wherein 50-90 wt.-% of all compounds according to formula (I) have n=3.

4. The functional fluid according to claim 1, wherein 10 to 50 wt.-% of all compounds according to formula (I) have n=4 or 5.

5. The functional fluid according to claim 1, wherein 2.5 wt.-% or less of all compounds according to formula (I) have n=2.

6. The functional fluid according to claim 1, wherein the content of component (A) in compounds according to formula (I) wherein n=1 is 1 wt.-% or less.

7. The functional fluid according to claim 1, wherein the content of component (A) in compounds according to formula (I) wherein n=6 or higher is 3 wt.-% or less.

8. The functional fluid according to claim 1, wherein the total content of the fluid in boric acid esters is at most 0.3 wt.-%.

9. The functional fluid according to claim 1, wherein 10 wt.-% or more of all compounds according to formula (II) have m=4.

10. The functional fluid according to claim 1, wherein $R_1$ is $C_2$ to $C_4$ alkyl, preferably ethyl or butyl.

11. The functional fluid according to claim 1, wherein in at least 75 wt.-% of all compounds according to formula (II) m=3.

12. The functional fluid according to claim 1, wherein 3 wt.-% or less of all compounds according to formula (II) have m=2.

13. The functional fluid according to claim 1, wherein 5 wt.-% or less of all compounds according to formula (II) have m=5 or higher.

14. The functional fluid according to claim 1, wherein the total amount of compounds according to formula (III), wherein k=2 is 1 to 15 wt.-% of the total fluid.

15. The functional fluid according to claim 1, wherein the total amount of compounds according to formula (III) wherein k=3 is 5 to 15 wt.-% of the total fluid.

16. The functional fluid according to claim 1, wherein the total amount of compounds according to formula (III) with k=4 or higher is 7 wt.-% or less of the total fluid.

17. The functional fluid according to claim 1, wherein a weight ratio between component (A) and component (B) is (A):(B)=82:1 to 6:1.

18. The functional fluid according to claim 1, wherein a weight ratio between compounds according to formula (I) with n=3 and n=4 or higher is (n=3):(n=4, or higher) is 1:1 to 6:1.

19. The functional fluid according to claim 1, wherein a weight ratio between component (A) and component (C) is (A):(C)=2.0:1 to 8.2:1.

20. The functional fluid according to claim 1, wherein component (D) is present in an amount of 0.4 to 6 wt.-%, and wherein the corrosion inhibitor is selected from the group consisting of $C_8$ to $C_{22}$ fatty acids, esters of phosphorus or phosphoric acid with $C_1$ to $C_{18}$ aliphatic alcohols, phosphites having at least one $C_1$ to $C_{12}$ hydrocarbon residue; heterocyclic organic compounds having at least one nitrogen atom as heteroatom, and mixtures thereof;

the stabilizer is selected from the group consisting of substituted phenols, sterically hindered amines and mixtures thereof;

the defoamer is selected from the group consisting of natural oils, glycerides, waxes, powdered silica, ethylene oxide/propylene oxide block copolymers, silicone based defoamers and mixtures thereof; and the lubricant is selected from the group consisting of polypropylene oxides, random poly ($C_2$- to $C_4$-alkylene) oxides, random mono $C_1$ to $C_4$ substituted poly ($C_2$- to $C_4$-alkylene) oxides, castor oil, ricinoleic acid, ethoxylates of castor oil or ricinoleic acid, and mixtures thereof.

21. The functional fluid according to claim 1, wherein the amine is selected from the group consisting of alkyl amines, cycloalkyl amines, alkanol amines, alkyl amine ethoxylates and mixtures thereof.

22. The functional fluid according to claim 1, comprising 0.3 to 2 wt.-% of an amine within the component (D), weight-% being relative to the fluid weight.

23. The functional fluid according to claim 1, wherein the fluid's content in esters of boric acid and glycol or alkyl polyglycol compounds is less than 3 wt.-%.

24. The functional fluid according to claim 1, the fluid having a kinematic viscosity of less than 800 centistokes at −40° C., a dry equilibrium reflux boiling point of at least 250° C. and a wet equilibrium reflux boiling point of at least 160° C.

25. A brake fluid comprising (A) from 50 to 85 wt.-% of alkoxy glycol according to formula (I)

$$CH_3—O—(CH_2—CH_2—O)_n—H \quad (I)$$

wherein n is a number from 2 to 5, with the proviso that in at least 30 wt.-% of all compounds according to formula (I), n is 3;

(B) from 1 to 15 wt.-% of alkoxy glycol according to formula (II)

$$R_1—O—(CH_2—CH_2—O)_m— \quad (II)$$

wherein $R_1$ is a $C_2$ to $C_8$ alkyl residue, m is a number from 2 to 6, with the proviso that in at least 65 wt.-% of all compounds according to formula (II), m is 3;

(C) from 6 to 35 wt.-% of at least one compound according to formula (III)

$$H—O—(CH_2—CH_2—O)_k—H \quad (III)$$

wherein k is a number of 2 or higher, with the proviso that in at least 80 wt.-% of all compounds according to formula (III), k is 2 or 3; and (D) at least one additive, selected from the group consisting of corrosion inhibitor, amines, stabilizers, defoamers and lubricants, wherein the fluid comprises at most 3 wt.-% of an ester of boric acid and a glycol or alkyl polyglycol compound.

26. A method of operating a vehicular brake, the method comprising the step of transmitting hydraulic pressure by a fluid comprising (A) from 50 to 85 wt.-% of alkoxy glycol according to formula (I)

$$CH_3—O—(CH_2—CH_2—O)_n—H \quad (I)$$

wherein n is a number from 2 to 5, with the proviso that in at least 30 wt.-% of all compounds according to formula (I), n is 3;

(B) from 1 to 15 wt.-% of alkoxy glycol according to formula (II)

$$R_1—O—(CH_2—CH_2—O)_m—H \quad (II)$$

wherein $R_1$ is a $C_2$ to $C_8$ alkyl residue, m is a number from 2 to 6, with the proviso that in at least 65 wt.-% of all compounds according to formula (II), m is 3;

(C) from 6 to 35 wt.-% of at least one compound according to formula (III)

$$H—O—(CH_2—CH_2—O)_k—H \quad (III)$$

wherein k is a number of 2 or higher, with the proviso that in at least 80 wt.-% of all compounds according to formula (III), k is 2 or 3; and (D) at least one additive, selected from the group consisting of corrosion inhibitor, amines, stabilizers, defoamers and lubricants, wherein the fluid comprises at most 3 wt.-% of an ester of boric acid and a glycol or alkyl polyglycol compound.

* * * * *